US007160160B2

(12) United States Patent
Kojima

(10) Patent No.: US 7,160,160 B2
(45) Date of Patent: Jan. 9, 2007

(54) STEERING HANDLEBAR FOR OUTBOARD MOTOR

(75) Inventor: Akiko Kojima, Hamamatsu (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 11/137,141

(22) Filed: May 25, 2005

(65) Prior Publication Data

US 2005/0262958 A1 Dec. 1, 2005

(30) Foreign Application Priority Data

May 25, 2004 (JP) ..... 2004-154124

(51) Int. Cl.
*B63H 5/125* (2006.01)

(52) U.S. Cl. ..... 440/63; 114/144 R

(58) Field of Classification Search ..... 440/53, 440/56, 61 R, 61 S, 63; 114/144 R
See application file for complete search history.

(56) References Cited

U.S. PATENT DOCUMENTS 4,337,053 A 6/1982 Stevens
4,925,411 A * 5/1990 Burmeister et al. ..... 440/56
5,180,320 A 1/1993 Calamia et al.
5,378,178 A * 1/1995 Haman ..... 440/53
5,545,064 A * 8/1996 Tsunekawa et al. ..... 440/53
5,736,700 A 4/1998 Takahashi et al.
6,093,066 A * 7/2000 Isogawa et al. ..... 440/63
6,406,342 B1 6/2002 Walczak et al.
6,715,438 B1 * 4/2004 Hundertmark ..... 114/144 R

FOREIGN PATENT DOCUMENTS

JP 05-147586 6/1993
JP 2513999 7/1996

* cited by examiner

*Primary Examiner*—Lars A. Olson
(74) *Attorney, Agent, or Firm*—Knobbe, Martens, Olson & Bear LLP

(57) ABSTRACT

The steering handlebar for outboard motor provided herein includes a power tilt and trim switch for adjusting a trim angle and a tilt angle of the outboard motor. The switch is advantageously mounted to the handlebar at a position that provides good operability. In one embodiment, the switch is mounted on a sideways-facing surface of the handlebar, forward of the accelerator grip. The switch does not rotate together with the accelerator grip of the handlebar, which results in the switch always being visible to the operator and easy to operate. Further, the lack of rotational coupling of these two components reduces wear on a lead wire of the switch, thereby prolonging the lifespan of the lead wire and the switch.

16 Claims, 7 Drawing Sheets

STEERING HANDLEBAR FOR OUTBOARD MOTOR

RELATED APPLICATION

This application claims priority to Japanese patent application Serial No. 2004-154124, filed on May 25, 2004, the entire contents of which are hereby expressly incorporated by reference.

BACKGROUND OF THE INVENTION

1. Field of the Invention

The present invention relates to a steering handlebar for operating an outboard motor and, in particular to a handlebar having controls that are easy to operate.

2. Description of the Related Art

Conventionally, an outboard motor for a boat includes a propulsion device and is mounted to the rear end of a hull of the boat. Some prior outboard motors include a steering handlebar that extends into the boat (into the area where the operator and passengers are located). The steering handlebar usually has a rod-shaped body connected to the outboard motor and extends generally horizontally. The outboard motor rotates about a generally vertical shaft. By moving the steering handlebar left or right, the operator is able to pivot the outboard motor about this generally vertical steering shaft to steer the boat. The handlebar body may be made of a metal, such as an aluminum alloy or the like, and is generally connected to the outboard motor so that it cannot rotate about its own longitudinal axis.

An accelerator grip attached to the front end of the handlebar body is rotatable about an axis of the handlebar body. An operator controls opening and closing of a throttle valve by holding and rotating the grip about this axis.

The outboard motor is rotatably mounted to the hull about a generally horizontal tilt shaft and is movable about the shaft through a hydraulic cylinder, for example. The outboard motor may thus be tilted up to be positioned above the surface of water for docking or to adjust its trim angle during running. The operator may adjust the trim angle as the boat moves up on plane, as known in the art. Some outboard motors include a power tilt and trim switch that enables the boat operator to more easily adjust a tilt or trim angle of the outboard motor during running. Japanese Patent Publication No. JP-A-H05-147586, for example, discloses a power tilt and trim switch that is disposed at the front end of the grip. This configuration may be difficult to operate if the operator has to release the grip, then hold it again, and then stretch his or her thumb toward the operation panel. Japanese Patent Publication No. JP-Y-2513999 discloses another switch that is disposed at the side of the grip. However, the switch rotates together with the grip and, thus, can be difficult to operate under some circumstances.

SUMMARY OF THE INVENTION

The preferred embodiments of the present steering handlebar for outboard motor have several features, no single one of which is solely responsible for their desirable attributes. Without limiting the scope of this steering handlebar as expressed by the claims that follow the specification, its more prominent features will now be discussed briefly. After considering this discussion, and particularly after reading the section entitled "Detailed Description of the Preferred Embodiments," one will understand how the features of the preferred embodiments provide advantages, which include easy operability with a simple design that reduces wear on components of the steering handlebar, thereby extending their life spans.

In accordance one aspect of the present invention, a steering handlebar for outboard motor is provided that includes a generally rod-shaped handlebar body connected to an outboard motor and extending outward therefrom. A grip is attached to a front end of the handlebar body and is rotatable about a longitudinal axis of the body. A switch for adjusting a trim angle and a tilt angle of the outboard motor is mounted on a side of the of the handlebar body near a front end thereof.

The switch for tilt and trim adjustment preferably is mounted to a portion of the handlebar body in close proximity of the thumb of an operator's hand, when the operator is holding the grip. This configuration allows the operator to easily operate the switch while holding the grip. Thus, when running the boat at high speed, the operator can operate the switch in a stable posture, without changing his or her posture and without releasing his or her other hand, with which he or she may supporting himself or herself. The switch also preferably does not rotate when the grip rotates. Therefore, no twist of the lead wire occurs.

The switch operation panel is preferably faces toward the operator's side, but may also face opposite the operator's side. Alternatively, it may face upward or downward, or in an inclined direction. Directing the operation panel to the operator's side improves the visibility of the switch, which is often used for trim adjustment during running the boat at high speed. The increased visibility increases the operability of the switch.

Another aspect of the present invention involves a steering handlebar for outboard motor. The steering handlebar includes an operation panel. The position of an operation panel of the switch is adjustable about the longitudinal axis of the grip. The position of the operation panel is thus adjustable to suit, for example, the size of the operator's hand. The switch is thus easily operated with the thumb of his or her hand holding the grip. This adjustability improves the operability of the switch.

An additional aspect of the present invention involves a steering handlebar for outboard motor in which a front end of the handlebar body includes an integral projecting portion that extends forward from a front end of the grip. The switch is mounted to the projecting portion. Because the front end of the handlebar body does not rotate about its own axis, the switch does not rotate with the grip when the operator turns the grip while operating the boat. Therefore, no twisting of the lead wire occurs, thereby reducing wear on the lead wire. Further, the operation panel remains at a set position, which further improves the operability of the switch.

In another embodiment of the present steering handlebar for outboard motor, a portion of the handlebar body to which the grip is attached includes a guide groove extending along its axial direction. A lead wire of the switch is provided in the guide groove. Housing the lead wire within the guide groove prevents rotation of the lead wire together with rotation of the grip, thus preventing twisting of the lead wire.

Another embodiment of the present steering handlebar for outboard motor includes a cover that extends over at least a portion of the handlebar body including at least a portion of the guide groove. The cover is fixed against rotation relative to the handlebar body. The cover separates the lead wire from the grip, reliably preventing rotation of the lead wire together with rotation of the grip, and insulating the lead wire from friction that would be caused by the grip rubbing against the lead wire.

In another embodiment of the present steering handlebar for outboard motor, the cover includes a notch. A projecting portion of the handlebar body seats within the notch so that the cover is fixed against rotation relative to the handlebar body. This simple structure, which avoids the use of screws or the like, prevents rotation of the cover and protects the lead wire.

In another embodiment, the present steering handlebar for outboard motor comprises a handlebar body extending generally horizontally from the outboard motor, a grip secured to the handlebar body adjacent a front end thereof, and a switch for adjusting a trim angle and a tilt angle of the outboard motor. The grip is rotatable about a longitudinal axis thereof. The switch is mounted on a side of the handlebar body adjacent the front end.

In another embodiment, the present steering handlebar for outboard motor comprises a handlebar body extending generally horizontally from the outboard motor, a grip secured to the handlebar body adjacent a front end thereof, and means for adjusting at least one of a trim angle and a tilt angle of the outboard motor. The grip is rotatable about a longitudinal axis thereof. Said means is mounted on a generally sideways-facing portion of the handlebar body adjacent the front end.

Some or all of the aspects and embodiments of the present outboard motor steering handlebar summarized above improve the ease and comfort of operating the controls for the outboard motor. They also can provide a simple structure for the controls and steering handle.

BRIEF DESCRIPTION OF THE DRAWINGS

The preferred embodiments of the present steering handlebar for outboard motor, illustrating its features, will now be discussed in detail. These embodiments depict the novel and non-obvious steering handlebar shown in the accompanying drawings, which are for illustrative purposes only. These drawings include the following figures, in which like numerals indicate like parts.

DETAILED DESCRIPTION OF THE PREFERRED EMBODIMENTS

Figure 1:
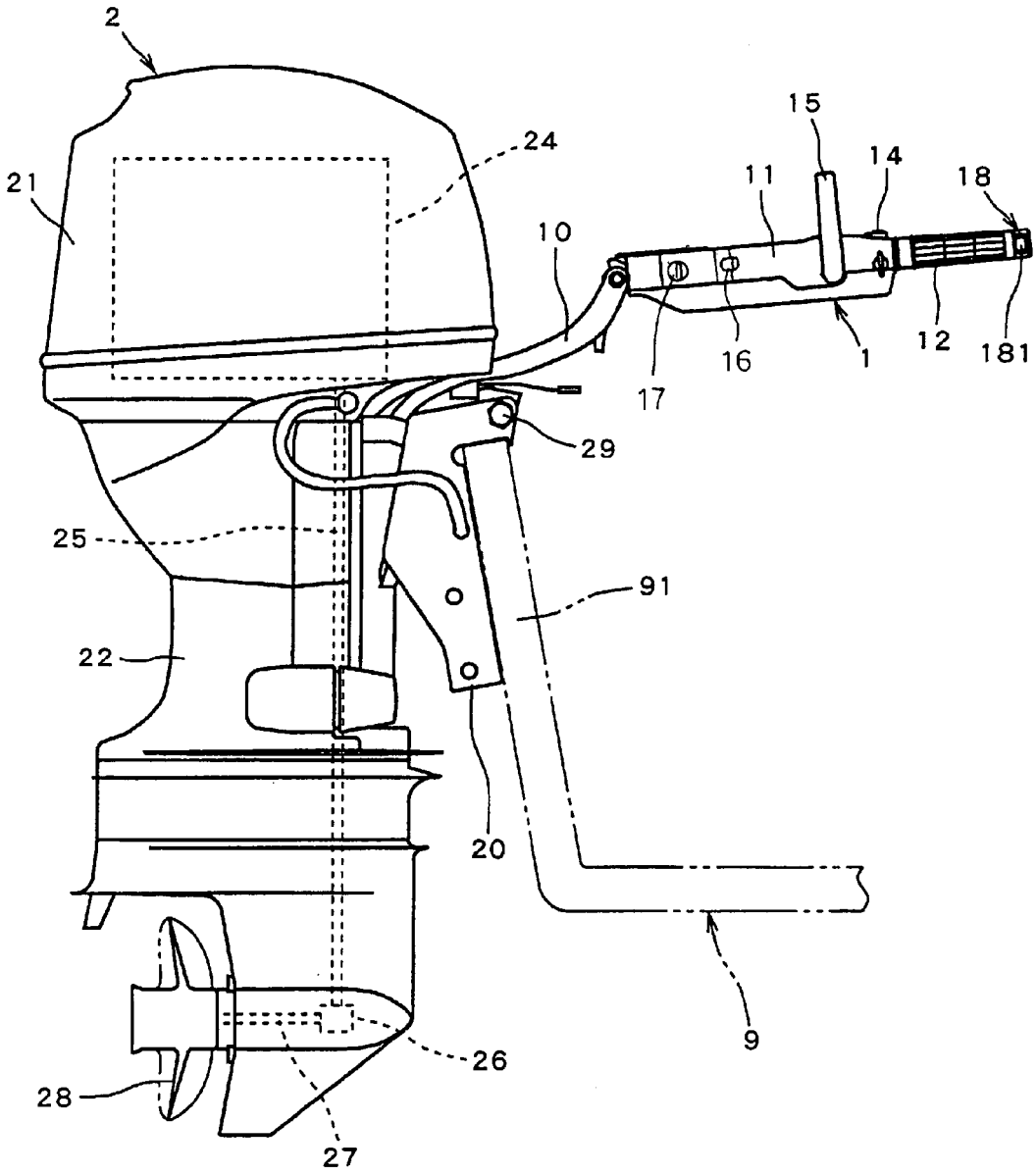
FIG. 1 is a side elevational view of an outboard motor including a preferred embodiment of the present steering handlebar for outboard motor.

FIG. 1 illustrates an outboard motor 2 including a preferred embodiment of the present steering handlebar for outboard motor. The outboard motor 2 includes a propulsion device covered by a cowling 21 and a casing 22 below the cowling. A clamp bracket 20 mounts the outboard motor 2 to a transom plate 91 of a hull 9.

The cowling 21 houses an engine 24, such as a four-stroke engine, for example. The engine 24 includes a crankshaft (not shown) that is generally disposed in a direction perpendicular to the surface of a body of water upon which the hull floats. The lower end of the crankshaft is connected to the upper end of a drive shaft 25. The lower end of the drive shaft 25 is connected to a gear mechanism 26 that may include a bevel gear, a forward-reverse shifting gear, and a clutch. These components are housed in a lower portion of the casing 22.

A propeller shaft 27 extends horizontally from the gear mechanism 26. The gear mechanism 26 includes a shifting mechanism that transmits the rotational force from the drive shaft 25, which rotates about a vertical axis, to the propeller shaft 27, which rotates about a horizontal axis. The shifting mechanism also shifts a transmission between forward and reverse modes in accordance with the rotational direction of the propeller shaft 25. A propeller 28 is mounted to an end of the propeller shaft 27, which projects outside the casing 22. Rotation of the propeller 28 underwater propels the hull 9.

Figure 3:
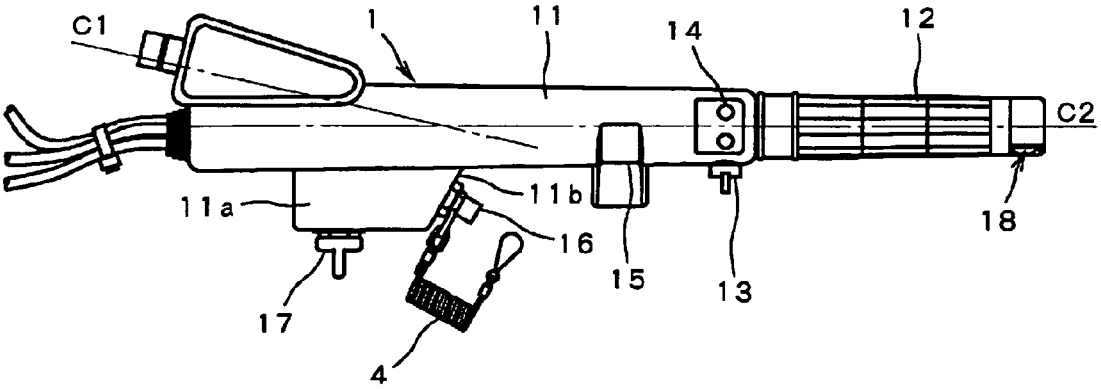
FIG. 3 is a top plan view of the steering handlebar of FIG. 1.
Figure 4:
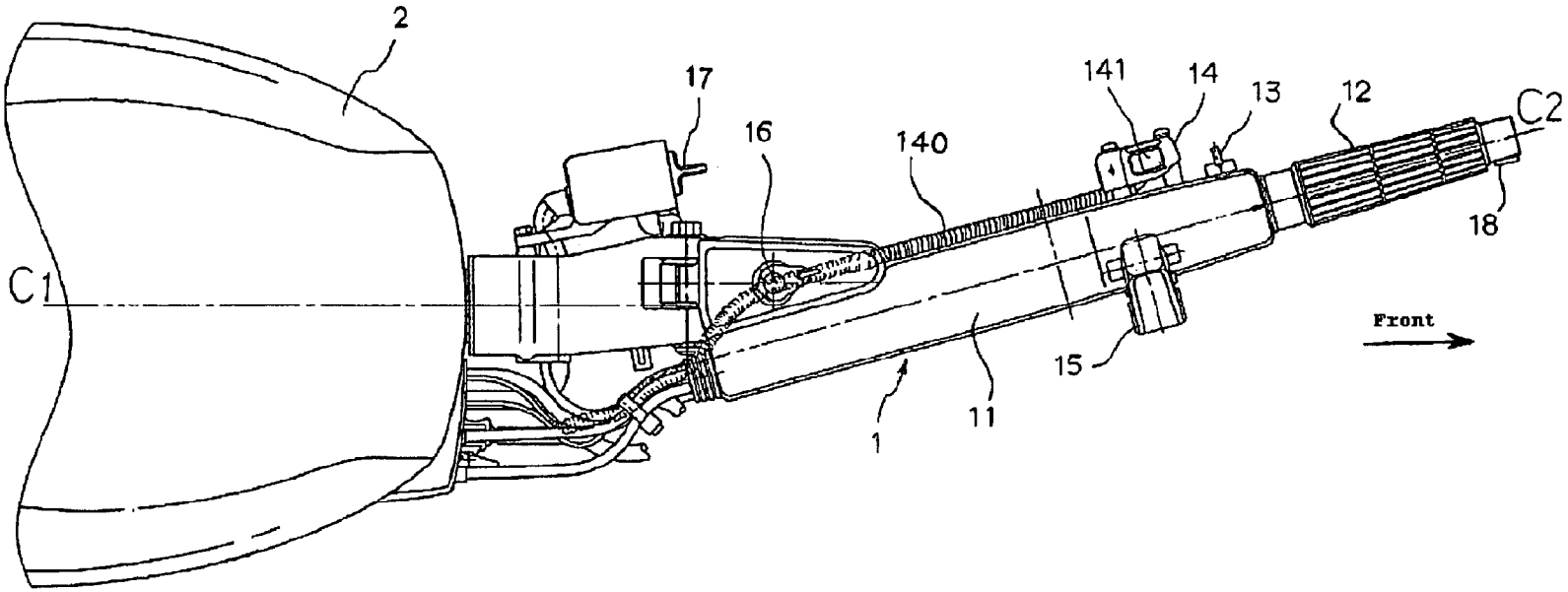
FIG. 4 is top plan view of an outboard motor including another preferred embodiment of the present steering handlebar for outboard motor.

With continued reference to FIG. 1, a steering handlebar 1 extends generally forward from the outboard motor 2. In the illustrated embodiment, the steering handlebar 1 is generally rod-shaped, and extends from a steering bracket 10 that extends generally toward the inside of the hull 9. An accelerator grip 12 disposed at the front end of the steering handlebar 1 controls opening and closing of a throttle valve (not shown) of the engine 24. The accelerator grip 12 is rotatable about the longitudinal axis C2 of the steering handlebar 1 (FIGS. 3 and 4). Turning the grip 12 about the axis C2 causes a throttle shaft 32 within the steering handlebar 1 (FIG. 5) to open and close the intake throttle valve (not shown) of the engine 24. Opening and closing of the intake throttle valve regulates the volume of air intake and thus controls output of the engine 24.

The grip 12 is preferably a plastic or rubber member that is formed with recesses and projections on its surface that increase friction applied to an operator's palm. The operator is thus less likely to slip off the grip. The operator seats himself/herself in the boat with the outboard motor 2 behind him/her and usually holds the grip 12 with his/her left hand to operate the steering handlebar 1.

Figure 5:
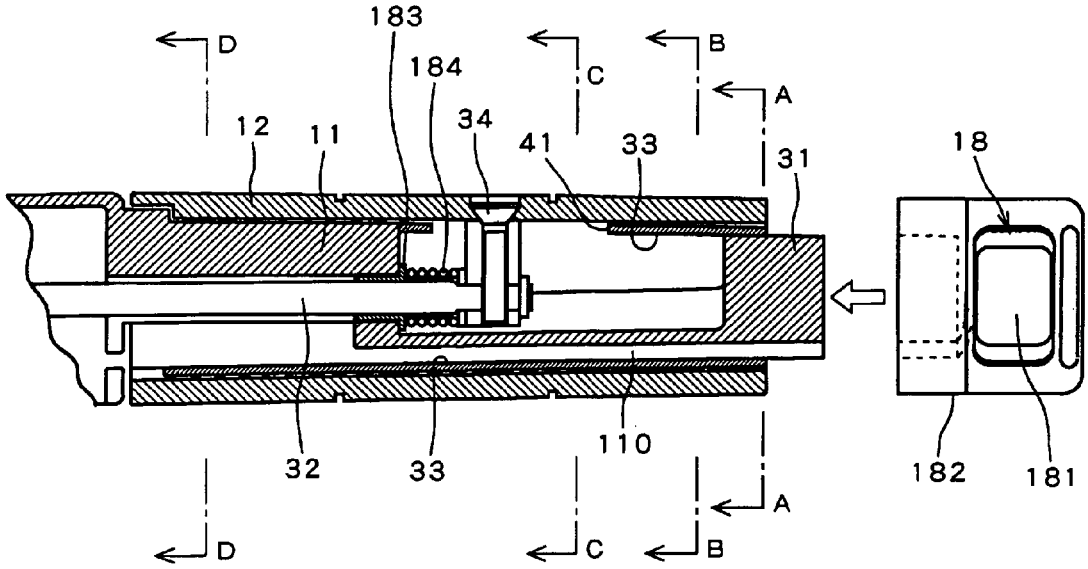
FIG. 5 is a cross-sectional view of the steering handlebar of FIG. 1 or FIG. 4.
Figure 6:
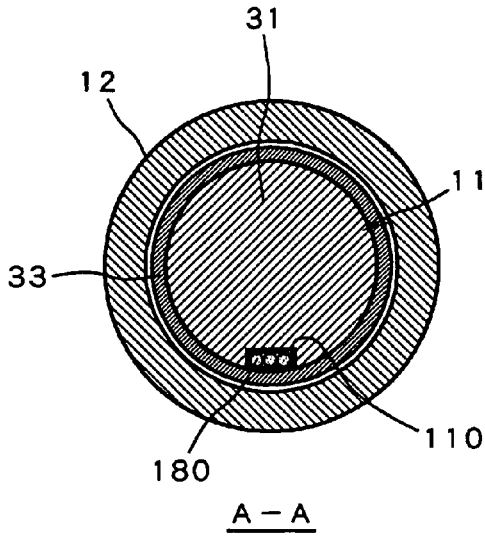
FIG. 6 is a cross-sectional view taken along the line A—A of FIG. 5.
Figure 7:
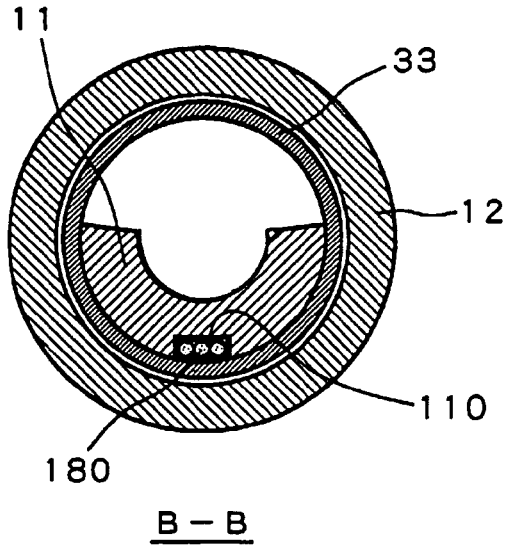
FIG. 7 is a cross-sectional view taken along the line B—B of FIG. 5.
Figure 8:
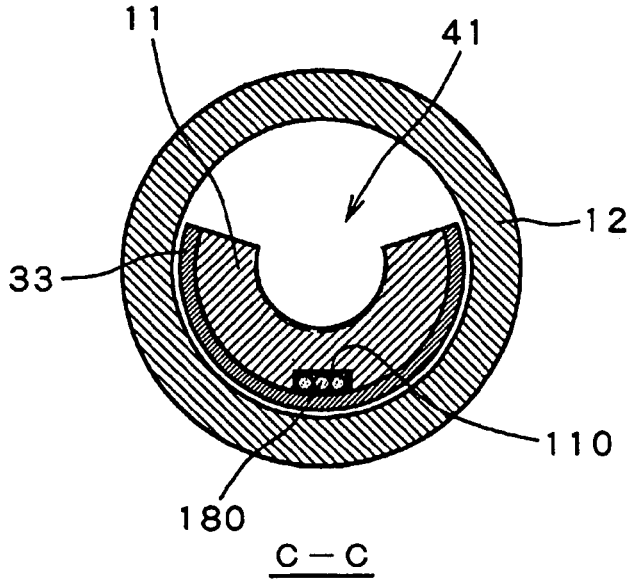
FIG. 8 is a cross-sectional view taken along the line C—C of FIG. 5.

The steering handlebar 1 includes a handlebar body 11. In the illustrated embodiment, the handlebar body 11 is generally rod-shaped, and may be constructed of an aluminum alloy that is cast or extruded. Those of ordinary skill in the art will appreciate that the handlebar body 11 may be differently shaped, and may be constructed of alternative materials. With reference to FIG. 5, the inside of the handlebar body 11 preferably includes at least some hollow space that accommodates a throttle shaft 32, lead wires of various switches, and other components. A front end of the handlebar body 11 includes the accelerator grip 12, which is rotatable about the axis C2 of the handlebar body 11. The handlebar body 11 preferably does not rotate about the axis C2.

With reference to FIG. 1, a shift lever 15 is positioned on the steering handlebar 1 between a base end thereof (adjacent the outboard motor 2) and the grip 12. The operator selects any of forward, reverse, and neutral modes by operating the shift lever 15.

A low-speed control switch 14 is provided on the handlebar body 11 in the vicinity of the shift lever 15. The low-speed control switch 14 regulates the opening of an ISC (idling speed control) valve, and hence engine output, when the boat is running at low speed, such as when trolling.

With continued reference to FIG. 1, the outboard motor 2 is mounted to rotate about a tilt shaft 29 so that its trim and tilt angles are adjustable. A power tilt and trim switch 18 is electrically connected to a drive device (not shown) of a hydraulic cylinder for trim and tilt operation. Operating the power tilt and trim switch 18 adjusts the trim and tilt angles. In a preferred embodiment, the power tilt and trim switch 18 is disposed adjacent the front end of the steering handlebar 1 such that its operation panel 181 is directed toward the operator. Those of ordinary skill in the art will appreciate that the power tilt and trim switch 18 may encompass embodiments that are adapted to adjust either the trim angle, or the tilt angle, or both of these angles.

Figure 2:
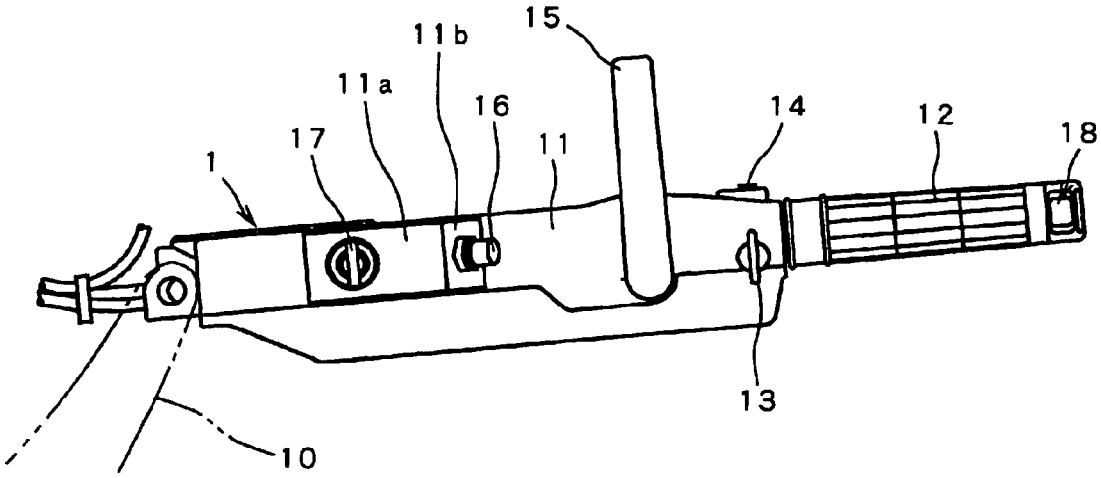
FIG. 2 is a side elevational view of the steering handlebar of FIG. 1.

With respect to FIGS. 2–4, in the illustrated embodiment the steering handlebar 1 further includes a throttle friction 13, a main switch 17, a kill switch 16 and a low-speed control switch 14. The throttle friction 13 regulates friction exerted by the grip 12. The main switch 17 starts the engine 24. The kill switch 16 forcibly stops the engine. The low-speed control switch 14 increases and decreases engine speed when the engine is running at low speed, such as when trolling. In FIGS. 2 and 3, the low-speed control switch 14 is disposed on the upper surface of the handlebar body 11 between the grip 12 and the shift lever 15. A strap 4 (FIG. 3) may connect the kill switch 16 to the operator so that the engine stops automatically when the operator falls out of the boat.

A projecting portion 31 (FIG. 5) of the handlebar body 11 extends generally horizontally and forward from a front end of the grip 12. Because the projecting portion comprises part of the handlebar body 11, it is not rotatable about the longitudinal axis C2 of the handlebar body 11. The power tilt and trim switch 18 is mounted to the projecting portion 31 such that the operation panel 181 thereof faces toward the side of the handlebar body 11 where the operator generally sits.

In the embodiment of FIGS. 2 and 3, the main switch 17 is mounted to a mounting portion 11*a* of the handlebar body 11, and projects toward the operator's side. The kill switch 16 is mounted to an inclined surface 11*b* of the mounting portion 11*a*, and projects toward the front of the boat and the operator. The kill switch 16 is located forward from the main switch 17.

In the embodiment of FIG. 3, the kill switch 16 is positioned closer to the axis C2 of the handlebar body 11 than the main switch 17 when viewed in plan. The power tilt and trim switch 18 is positioned closer to the axis C2 of the handlebar body 11 than the kill switch 16. The main switch 17, the kill switch 16, and the power tilt and trim switch 18 are all located at the side of the handlebar body 11 that is closest to the operator. Locating the power tilt and trim switch 18 forward from the kill switch 16 and close to an operator's hand, and the main switch 17 used for starting and stopping the engine rearward from the kill switch 16, as in the forgoing configuration, improves operability. However, those of ordinary skill in the art will appreciate that the arrangement of these components could be modified. Those of ordinary skill in the art will also appreciate that the configuration shown in FIG. 3 is adapted to accommodate an operator that is positioned such that the outboard motor is on his or her left-hand side. The configuration shown in FIG. 3 could be mirrored about the axis C2 to produce a steering handle that would accommodate an operator that is positioned such that the outboard motor is on his or her right-hand side.

FIG. 4 illustrates, in top plan aspect, an alternative arrangement for the controls of the present steering handlebar. In the embodiment of FIGS. 2 and 3, the kill switch 16 and the main switch 17 are mounted at the side of the handlebar body 11 on the operator side. In the embodiment of FIG. 4, the kill switch 16 is mounted to the upper surface of the handlebar body 11, and the main switch 17 is mounted to the side of the handlebar body 11 opposite the operator side. In addition, the low-speed control switch 14 and the throttle friction 13 are mounted to the side of the handlebar body 11 opposite the operator side.

As shown in the top plan aspect of FIG. 4, the longitudinal axis C2 of the steering handlebar 1 is inclined with respect to the centerline C1 of the outboard motor 2. In this configuration, the operator preferably sits to the right side of the steering handlebar 1 (toward the bottom of FIG. 4), which is inclined away from the operator to the left-hand side. The power tilt and trim switch 18 is located adjacent the front end of the steering handlebar 1 and faces toward the operator's side. The low-speed control switch 14 is located on the side of the steering handlebar 1 opposite the operator's side. The operation panel 141 of the low-speed control switch 14 faces upward. In the embodiment of FIG. 4, a lead wire 140 connects the low-speed control switch 14 to an engine control device (not shown) of the outboard motor. The low-speed control switch 14 and sends signals to increase or decrease engine speed through the lead wire 140 to the engine control device. The engine control device may control an ISC (idling speed control) valve (not shown), for example, based on the sent signal to regulate the volume of air intake to the engine.

In the embodiments described above, the power tilt and trim switch 18 is advantageously located forward from a front end of the grip 12, such that the switch 18 does not rotate with the grip as the user accelerates and decelerates the outboard motor. The power tilt and trim switch 18 is also advantageously located on the side of the steering handlebar 1 that faces the operator (when the operator holds the steering handlebar with the outboard motor behind him or her). Further, the steering handlebar 1 is inclined with respect to the centerline of the outboard motor. All of these features contribute to the ability of the boat operator to easily and reliably operate the switch 18 in a natural manner, without having to change his or her posture, to make trim adjustments while running the boat at high speed. Of course, as those of ordinary skill in the art will appreciate, each of the features described above contributes to the easy operability of the switch 18, but none is essential to achieve the advantageous characteristics of the present steering handlebar.

The attitude of the hull 9 is sometimes unstable when the boat is running at high speed. Therefore, the operator is preferably able to operate the boat while looking ahead carefully in a stable posture. In the embodiments described above, the power tilt and trim switch 18, which is often used for running the boat at high speed, is located forward from the front end of the grip 12 and on the side of the steering handlebar facing the operator. Thus, the operator can make trim adjustments without changing his or her posture while running the boat at high speed. Further, the low-speed control switch 14, which is used mostly for running the boat at low speed, is located below the base of the grip 12 and either on the side of the handlebar body opposite the operator (FIG. 4) or on the upper side of the handlebar body (FIGS. 2 and 3). Thus, the operator can operate both the power tilt and trim switch and the low-speed control switch without mixing them up.

FIG. 5 illustrates a cross-sectional view of the steering handlebar 1 and grip 12. As described above, a front end of the handlebar body 11 projects forward from the grip 12 and forms the projecting portion 31, which is integral with the handlebar body 11. The projecting portion 31 fits within a casing 182 of the power tilt and trim switch 18. The switch 18 is mounted to the projecting portion 31 in a manner such that its operation panel 181 faces toward the operator. For example, the casing 182 may include a slot (not shown) formed in its side, and the projecting portion 31 may include a threaded hole (not shown). A screw may engage the slot and the threaded hole to allow fine adjustment of the orientation of the operation panel 181 with respect to the rotational direction of the grip 12 to obtain the optimum orientation relative to the operator.

In some embodiments, and without limitation, the power tilt and trim switch 18 may be a tumbler switch (toggle switch), which is depressed at one half while the other half is raised, or a slide switch. The trim and tilt angles of the outboard motor 2 can be adjusted in accordance with the operator's depression of the tumbler switch or the direction in which the operator slides the slide switch.

Figure 11:
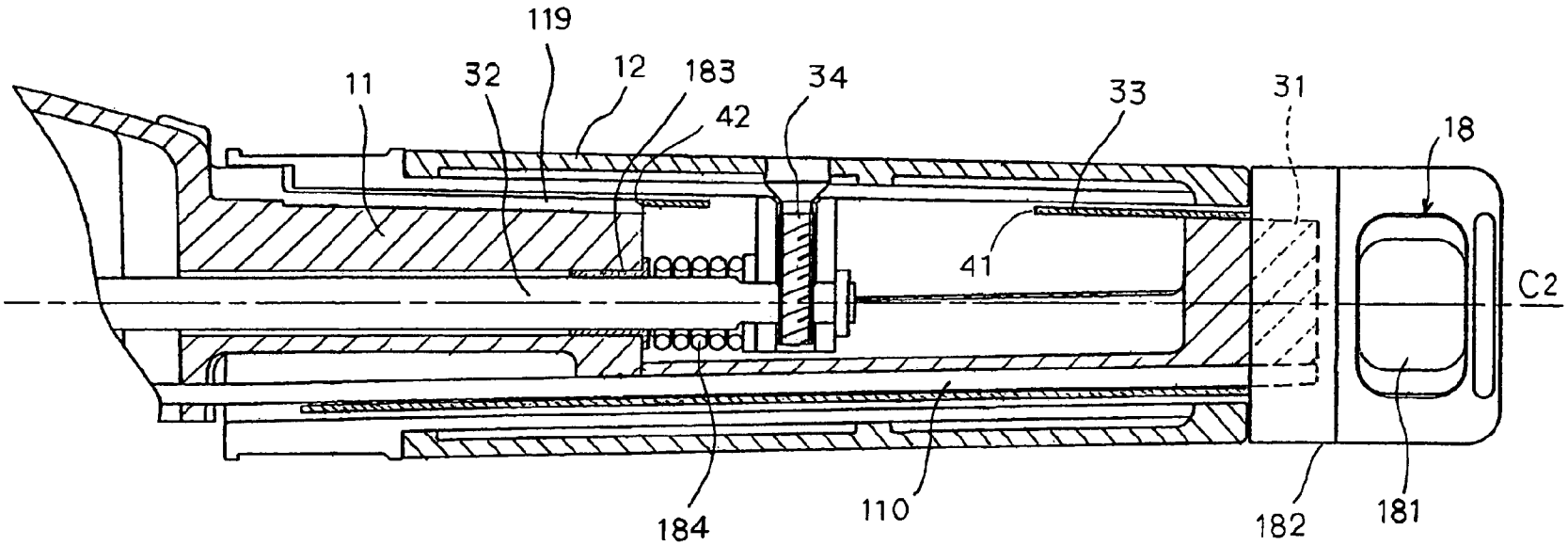
FIG. 11 is a cross-sectional view of another preferred embodiment of the present steering handlebar for outboard motor.

With further reference to FIG. 5, a screw 34 secures the grip 12 to the throttle shaft 32 so that as the operator rotates the grip 12 the throttle shaft 32 also rotates. Those of ordinary skill in the art will appreciate that other methods of coupling the grip 12 and the throttle shaft 32 could be used instead. With further reference to FIG. 11, a bushing 183 holds the throttle shaft 32, which is extends along the axis C2 of the handlebar body 11. A spring 184 returns the grip 12 to its original position after the operator turns the grip 12 and releases it.

With reference to FIGS. 5–8 and 11, in the illustrated embodiment, a portion of the handlebar body 11 to which the grip 12 attaches includes an axial guide groove 110. As the cross-sectional views of FIGS. 6–9 illustrate, the guide groove 110 is adapted to receive a lead wire 180 of the power tilt and trim switch 18. The lead wire 180 is connected to a control section (not shown) for controlling the trim and tilt angles. Because the switch 18 is secured to the handlebar body 11, it does not rotate with the grip 12. Because the switch 18 does not rotate, the lead wire 180 does not twist as the handle 12 rotates. This configuration reduces wear to the lead wire 180.

Figure 9:
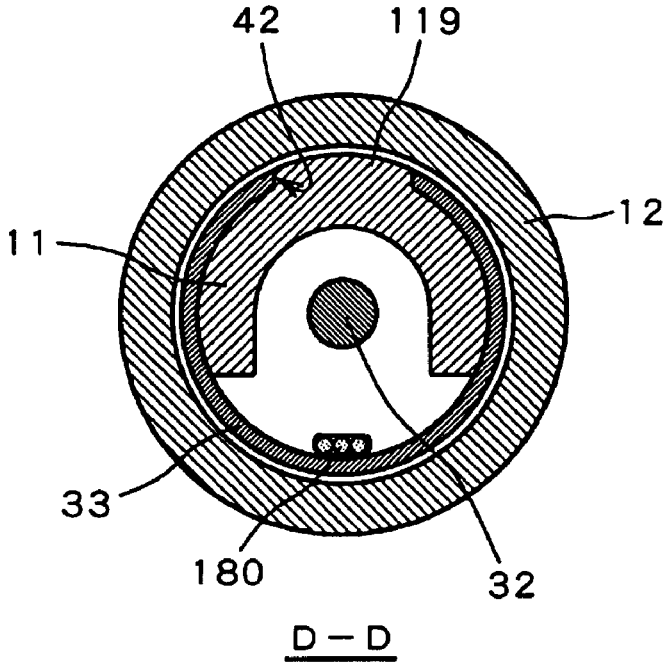
FIG. 9 is a cross-sectional view taken along the line D—D of FIG. 5.
Figure 10:
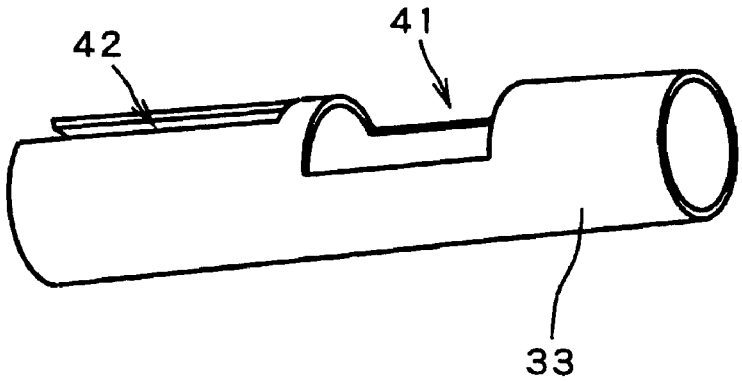
FIG. 10 is a perspective view of the cover illustrated in FIGS. 5–9.

A cover 33, illustrated in detail in FIG. 10, closes the open side of the guide groove 110. With reference to FIGS. 6–9, the cover 33 is disposed along the inner side of the grip 12 and covers the outside periphery of the portion of the handlebar body 11 to which the grip 12 attaches. The cover 33 advantageously provides a barrier between the grip 12 and the lead wire 180. This barrier prevents rotation of the lead wire 180 in the guide groove 110 as the grip 12 rotates, and eliminates friction between the grip 12 and the lead wire 180 that might tend to reduce the lifespan of the lead wire 180.

In one embodiment, the cover 33 is constructed of a plastic, and has a generally cylindrical shape. The cover 33 includes two notches 41, 42 along its side that extend in the axial direction, as shown in FIG. 10. With reference to FIG. 5, the notch 41 accommodates the screw 34 that connects the grip 12 to the throttle shaft 32. The grip 12 and throttle shaft 32 are thus able to rotate together independently of the cover 33. With reference to FIGS. 5 and 9, a projecting portion 119 of the handlebar body 11 resides within the notch 42 and aids in preventing the cover 33 from rotating together with the grip 12. As explained above, this configuration avoids the undesirable effects of having the lead wire 180 be twisted or rubbed when the grip 12 is operated, which would tend to wear on and damage the lead wire 180.

As explained in detail above, the power tilt and trim switch 18 is disposed adjacent the front end of the steering handlebar. Since the operation panel 181 of the power tilt and trim switch 18 faces the operator and is in close proximity to his or her thumb, the operator can easily operate the operation panel 181 while keeping the same posture. Therefore, when adjusting the trim angle while running the boat at high speed, the operator can easily operate the switch without having to release the grip and then hold it again, or having to use his or her other hand. Furthermore, mounting the power tilt and trim switch on the side of the steering handlebar facing the operator such that its operation panel 181 is directed toward the operator provides good visibility and thus further improves operability. Because the switch 18 does not rotate with the grip 12, the switch can always be oriented in the most convenient fashion, and twisting of the lead wire 180 is prevented.

FIG. 11 shows an alternative configuration of the grip of the handlebar shown in FIG. 5. In FIG. 11, the casing 182 of the power tilt and trim switch 18 is shown fitted on the projecting portion 31 of the front end of the handlebar body 11. Components shown in FIG. 11 are similar to those in FIGS. 5–10, which are described above and are denoted by the same reference numerals.

The above presents a description of the best mode contemplated for carrying out the present steering handlebar for outboard motor, and of the manner and process of making and using it, in such full, clear, concise, and exact terms as to enable any person skilled in the art to which it pertains to make and use this steering handlebar. This steering handlebar is, however, able to modifications and alternate constructions from that discussed above that are fully equivalent. Consequently, this present invention is not limited to the particular embodiments disclosed. On the contrary, the present invention is intended to include all modifications and alternate constructions coming within the spirit and scope of the invention as generally expressed by the following claims, which particularly point out and distinctly claim the subject matter of the steering handlebar.

What is claimed is:

1. A steering handlebar for an outboard motor, comprising:

a handlebar body extending generally horizontally from the outboard motor;

a grip secured to the handlebar body adjacent a front end thereof, the grip being rotatable about a longitudinal axis thereof; and a switch for adjusting a trim angle and a tilt angle of the outboard motor;

wherein the switch is mounted on a side of the handlebar body adjacent the front end, and the grip is rotatable independently of the switch, such that rotation of the grip does not induce rotation of the switch.

2. The steering handlebar of claim 1, wherein the handlebar body is generally rod-shaped.

3. The steering handlebar of claim 1, wherein the front end of the handlebar body includes an integrally formed projecting portion that extends forwardly of a front end of the grip, and the switch is mounted to the projecting portion.

4. The steering handlebar of claim 1, wherein at least a portion of the handlebar body to which the grip is attached includes a guide groove that extends along the axial direction of the handlebar.

5. A steering handlebar for an outboard motor, comprising:

a handlebar body extending generally horizontally from the outboard motor;

a grip secured to the handlebar body adjacent a front end thereof, the grip being rotatable about a longitudinal axis thereof; and a switch for adjusting a trim angle and a tilt angle of the outboard motor;

wherein the switch is mounted on a side of the handlebar body adjacent the front end; and the switch includes an operation panel, and a position of the operation panel is adjustable about the longitudinal axis of the grip.

6. The steering handlebar of claim 5, wherein the operation panel faces generally horizontally.

7. A steering handlebar for an outboard motor, comprising:

a handlebar body extending generally horizontally from the outboard motor;

a grip secured to the handlebar body adjacent a front end thereof, the grip being rotatable about a longitudinal axis thereof; and a switch for adjusting a trim angle and a tilt angle of the outboard motor;

wherein the switch is mounted on a side of the handlebar body adjacent the front end;

at least a portion of the handlebar body to which the grip is attached includes a guide groove that extends along the axial direction of the handlebar; and the guide groove is adapted to receive a lead wire of the switch.

8. The steering handlebar of claim 7, further comprising a cover that at least partially encloses the handlebar body, including at least a portion of the guide groove.

9. The steering handlebar of claim 8, wherein the cover is fixed against rotation relative to the handlebar body.

10. The steering handlebar of claim 9, wherein the cover includes at least one notch, and a projecting portion of the handlebar body seats within the notch so that the cover cannot rotate relative to the handlebar body.

11. A steering handlebar for an outboard motor, comprising:

a handlebar body extending generally horizontally from the outboard motor;

a grip secured to the handlebar body adjacent a front end thereof, the grip being rotatable about a longitudinal axis thereof; and means for adjusting at least one of a trim angle and a tilt angle of the outboard motor;

wherein said means is mounted on a generally sideways-facing portion of the handlebar body adjacent the front end, and said means is adapted to be fixed against rotation relative to the handlebar body, such that rotation of the grip does not alter the orientation of said means.

12. The steering handlebar of claim 11, wherein at least a portion of the handlebar body to which the grip is attached includes a guide groove that extends along the axial direction of the handlebar.

13. A steering handlebar for an outboard motor, comprising:

a handlebar body extending generally horizontally from the outboard motor;

a grip secured to the handlebar body adjacent a front end thereof, the grip being rotatable about a longitudinal axis thereof; and means for adjusting at least one of a trim angle and a tilt angle of the outboard motor;

wherein said means is mounted on a generally sideways-facing portion of the handlebar body adjacent the front end;

at least a portion of the handlebar body to which the grip is attached includes a guide groove that extends along the axial direction of the handlebar; and the guide groove is adapted to receive a lead wire of said means.

14. The steering handlebar of claim 13, further comprising a cover that at least partially encloses the handlebar body, including at least a portion of the guide groove.

15. The steering handlebar of claim 14, wherein the cover is fixed against rotation relative to the handlebar body.

16. The steering handlebar of claim 15, wherein the cover includes at least one notch, and a projecting portion of the handlebar body seats within the notch so that the cover cannot rotate relative to the handlebar body.

* * * * *